United States Patent [19]

Sawyer et al.

[11] Patent Number: 4,739,880

[45] Date of Patent: Apr. 26, 1988

[54] LAUNDRY HAMPER

[76] Inventors: Warren D. Sawyer; Mark W. Sawyer, both of 3868 Circle Dr., Indianapolis, Ind. 46220

[21] Appl. No.: 105,494

[22] Filed: Oct. 2, 1987

Related U.S. Application Data

[63] Continuation of Ser. No. 837,778, May 10, 1986, abandoned.

[51] Int. Cl.[4] ..... B65D 33/28; B65D 88/16

[52] U.S. Cl. ..... 206/223; 150/49; 206/280; 383/72; 383/111

[58] Field of Search ..... 383/43, 72, 75, 76, 383/104, 109, 111, 119; 206/223, 280, 577; 141/390; 150/48–51

[56] References Cited

U.S. PATENT DOCUMENTS

| | | | |
|---|---|---|---|
| 576,782 | 2/1897 | Goodrich . | |
| 1,044,023 | 11/1912 | Colgate . | |
| 1,129,495 | 2/1915 | Kiger | 383/111 |
| 1,139,281 | 5/1915 | Hazelton . | |
| 1,647,679 | 11/1927 | Williams | 150/49 |
| 1,907,172 | 5/1933 | Arzet | 383/121 |
| 2,080,252 | 5/1937 | Cook | 383/72 |
| 2,156,831 | 5/1939 | Andre | 383/75 |
| 2,425,683 | 8/1947 | Martin | 383/75 |
| 2,610,757 | 9/1952 | Irvine | 206/811 |
| 2,767,757 | 10/1956 | Marder | 150/51 |
| 3,193,065 | 7/1965 | Politzer | 383/72 |
| 3,249,286 | 5/1966 | Palmer | 383/104 |
| 3,789,897 | 2/1974 | Saito | 383/75 |
| 3,915,329 | 10/1975 | Zaks | 220/65 |
| 3,943,988 | 3/1976 | Consorti | 383/119 |
| 3,983,914 | 10/1976 | Benson | 141/390 |
| 4,014,157 | 3/1977 | Pearce | 53/35 |
| 4,037,778 | 7/1977 | Boyle | 229/55 |
| 4,102,376 | 7/1978 | Sharp | 383/111 |
| 4,115,909 | 9/1978 | Corella | 229/48 |
| 4,267,868 | 5/1981 | Lowe | 383/74 |
| 4,509,643 | 4/1985 | Rhee | 206/315.8 |
| 4,628,007 | 12/1986 | Ledsham | 220/403 |

FOREIGN PATENT DOCUMENTS

| | | | |
|---|---|---|---|
| 459687 | 1/1937 | United Kingdom | 383/111 |

*Primary Examiner*—Stephen Marcus
*Attorney, Agent, or Firm*—Barnes & Thornburg

[57] ABSTRACT

A hamper comprising a bag formed to have a closed bottom end, an open top end and a sidewall extending therebetween, a cylindrical shell insertable into the bag to provide an upright support, the shell having an upper edge defining a shell upper opening plane, and the bag having a drawstring for drawing the open end into a bag opening smaller than the shell upper opening and lying generally in the shell upper opening plane.

13 Claims, 2 Drawing Sheets

LAUNDRY HAMPER

This is a continuation of application Ser. No. 837,778, filed May 10, 1986 and entitled Laundry Hamper of inventor W. David Sawyer, et al, now abandoned.

The present invention relates to hampers, and more particularly to laundry hampers for use in storing laundry and transporting it to and from laundry facilities.

Our invention is an improved laundry hamper in that it combines the well-known and worthwhile features of a stationary, rigid and upright laundry hamper and a soft, flexible laundry bag which is very easy to transport. Our improved hamper comprises a laundry bag which is supported by an internal shell to stand upright to provide an access opening at the top for receiving the laundry items.

The prior art, of course, includes a wide variety of laundry hampers and laundry bags including duffel bags. The prior art also includes a variety of issued U.S. patents which show all sorts of bags, including refuse bags, with upright shells inside the bags to provide structural support and open top ends. Such prior U.S. patents are as follows: U.S. Pat. Nos. 576,782; 1,044,023; 1,139,281; 3,915,329; 3,983,914; 4,014,157; 4,037,778; 4,115,909; and 4,509,643.

We believe our hamper constitutes a significant improvement over the prior art for several reasons. Our hamper comprises a very durable and reusable bag, usually a durable cloth material bag, which can be used over and over again for many years conveniently to transport the laundry. Our presently preferred bag is a generally cylindrical bag having an open top end with a reduction means, such as a drawstring, to reduce the top end from a size generally equal to the diameter of the bag to a size small enough to restrain the laundry items. Inside this drawstring bag we place a collapsible cylindrical shell to support the bag in an upright fashion. After the removable shell is inserted into the bag and radially expanded, the upper end can be closed downwardly to an opening smaller than the diameter of the bag to lie generally in the plane of the upper edge of the shell. Our preferred support shell is a rectangular sheet of plastic material roll-formed or otherwise formed to provide a collapsible generally cylindrical shell. We take such a sheet of plastic and roll-form it so that it can be shipped in a tight tubular form and, when released, expanded outwardly to the diameter of the laundry bag. The plastic material will have sufficient memory to expand radially outwardly to the diameter of the bag.

Our invention, therefore, is a hamper comprising a bag formed to have a closed bottom end, an open top end, and sidewall means extending therebetween. Collapsible means is provided to be inserted into the bag and expanded. This collapsible means, when expanded, provides an upright support shell for the bag. This shell provides an upper edge defining a shell upper opening plane. The bag is provided with reduction means for drawing the open end into a bag opening smaller than the shell upper opening and lying generally in the shell upper opening plane.

Figure 2:
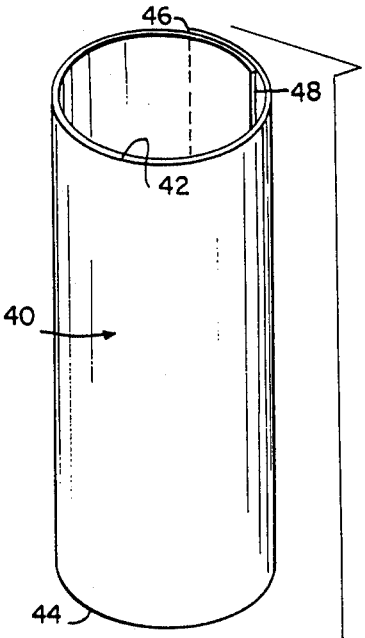
FIG. 2 is an exploded perspective view of the hamper.
Figure 4:
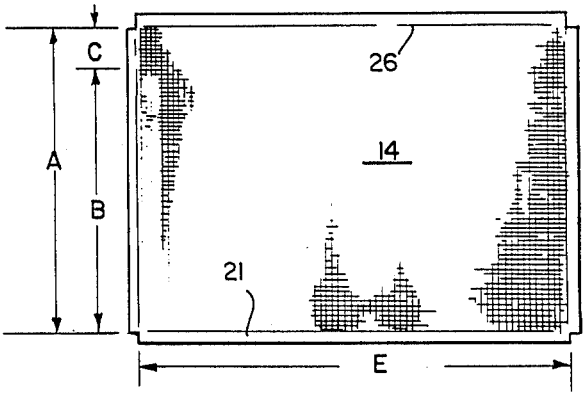
FIG. 4 is an elevational view of the sidewall of the bag portion of the hamper.

Referring particularly to the drawstrings, it will be seen that our clothes hamper 10 comprises a generally cylindrical duffel bag 12 having an outer cylindrical wall 14 which terminates at its bottom edge 16 and its top edge 18 (FIG. 2). The bag has a generally circular bottom 20. The bottom 20 and the sidewall 14 are joined along the bottom seam line 21 (FIG. 4) of the sidewall, the stitching being indicated by the reference numeral 22 (FIG. 2). The top end 18 of the bag 12 is sewn as indicated at 24 to provide a sheath for receiving a drawstring. Specifically, the upper edge 18 is turned down and sewn along the line 26 shown in FIG. 4 to provide the drawstring sheath 24. The stitching along this line 26 is indicated at the reference numeral 28 in FIG. 2. The drawstring, indicated at 30, may be any tough and flexible cord placed in the sheath 24 so that it has two loose ends 32,34. These ends may be gathered together and threaded through a lock or clamp 36. A clamp which might be used is illustrated in U.S. Pat. No. 4,328,605. Such a clamp may be used to lock the drawstrings at any selected position.

Figure 3:
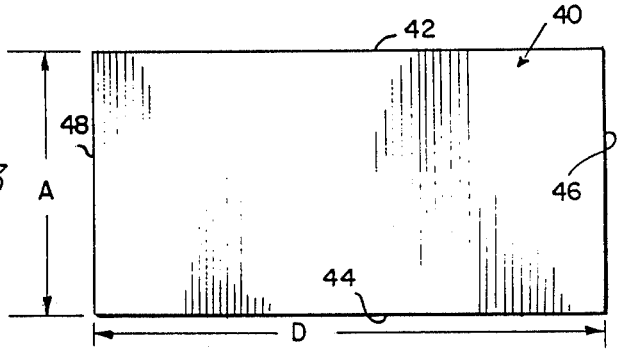
FIG. 3 is an elevational view of the plastic sheet which is rolled up to form the support shell.
Figure 6:
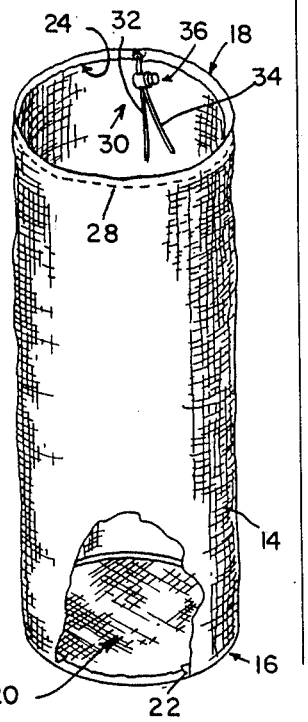
FIG. 6 is a sectional view taken along lines 6—6 of FIG. 5.
Figure 6:
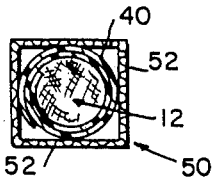
Figure 5:
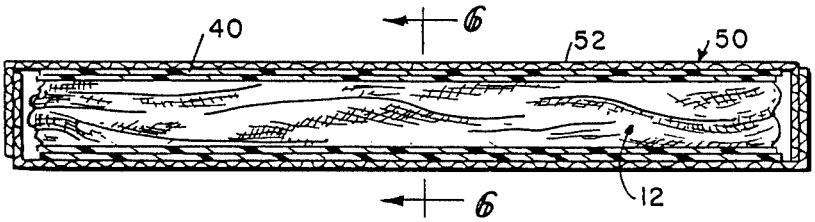
FIG. 5 is a sectional view of one illustrative technique for packaging the hamper for shipment and sale.
Figure 7:
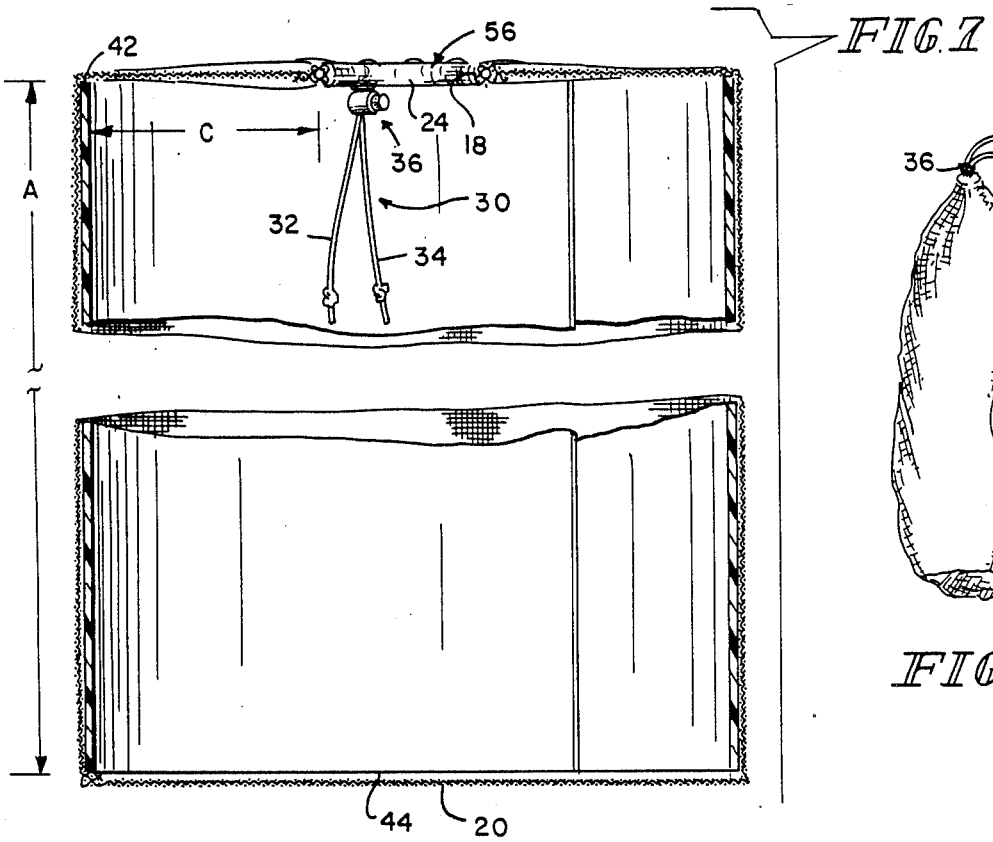
FIG. 7 is a sectional view of the hamper showing the details of the top end portions.
Figure 8:
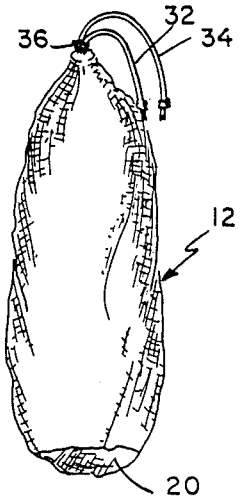
FIG. 8 shows the bag with the shell support removed.

In our preferred embodiment, the support shell 40 is a plastic sheet (FIG. 3) having a height A and a length D, an upper edge 42, a lower edge 44, and end edges 46,48. This plastic sheet is roll-formed or otherwise formed such that it will assume a generally cylindrical shape with the ends 46,48 overlapping as shown in FIG. 2. The sheet 40 may be a high density polyethylene sheet which may be rolled tightly down to a relatively small diameter tubular shape as shown in FIGS. 5 and 6. When the sheet is released from its tightly rolled state, it will assume a generally cylindrical shape with the overlapping ends 46,48 as shown in FIG. 2. It will be appreciated that this shell will be resiliently expandable generally radially outwardly to the diameter of the bag 12. It will be seen in FIG. 4 that the sidewall 14 of the bag 12 has, when flattened out, a length E somewhat less than the shell length D. The sidewall 14 has a height B which is greater than the height A of the shell by the distance C. Because of this proportioning and sizing, when the shell is rolled as shown in FIG. 2 and inserted into the bag 12, the upper edge 42 of the shell will be below the upper end edge 18 of the bag by the distance C. When the drawstring 30 is tightened as shown in FIG. 7, the upper end portion of the bag will form a plane as shown in FIG. 7 lying generally in the plane defined by the circular upper edge 42 of the shell 40. The distance C is selected to provide for a hamper opening as indicated at 56 through which soiled laundry may be dropped into the hamper 10. When it is time to take the laundry to the laundry facility, the shell 40 may be removed from the bag leaving the laundry therein to produce a duffel bag 12 filled with soiled laundry as shown in FIG. 8. Because the shell 40 is relatively soft, many people may prefer to leave it in even when transporting the hamper 10.

Figure 1:
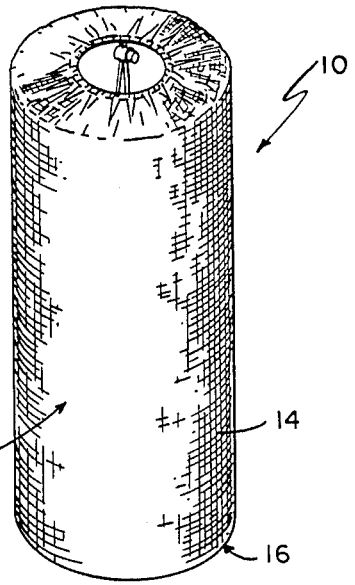
FIG. 1 is a perspective view of the preferred hamper of our invention.

Our hamper is particularly attractive in the configuration shown in FIGS. 1 and 7. It will be appreciated that the bag 12 itself may be made from a wide variety of cloth materials having a wide variety of decorative patterns or colors. For use in college dorms, the bags may be decorated with the college or university logos.

Our concept of having the upper end of the hamper be horizontal with a concentric opening 56 provides a particularly attractive and useful structure. It is relatively easy to use and the opening 56 may be easily enlarged, if necessary, by operating the lock 36 to loosen the drawstring 30 forming the opening 56.

Another attractive feature of our hamper is the packaging and shipping feature shown in FIGS. 5 and 6. Specifically, the shell 40 may be rolled tightly as shown in FIGS. 5 and 6 to provide a tubular receptor for the bag 12. This tubular arrangement may be inserted into a shipping container 50 having corrugated sidewalls as indicated at 52. It will be appreciated that this packaging technique is merely illustrative.

Figure 9:
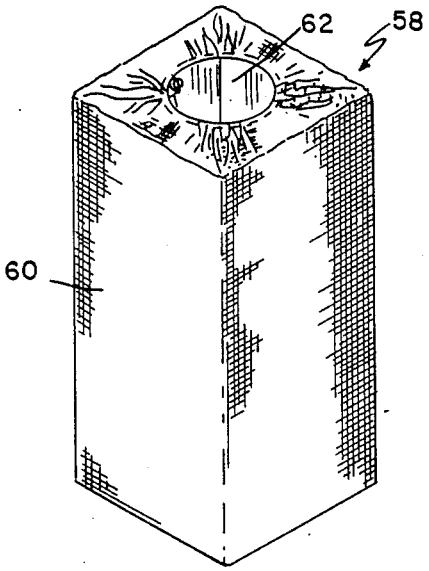
FIG. 9 shows an alternative form of the hamper using a four-sided shell support.
Figure 10:
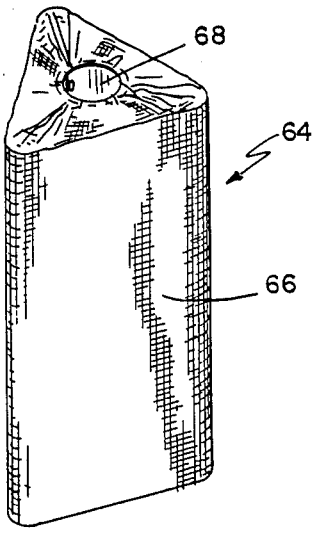
FIG. 10 is a perspective view showing an alternative hamper with a three-sided shell support.

FIGS. 9 and 10 represent alternative forms of our hamper. In FIG. 9, we show a hamper 58 comprising a bag 60 into which a four-sided support shell 62 may be inserted. it will be appreciated that the bag 60 may be cut and sewn to have four sides to accommodate the four sides of the removable shell 62. In FIG. 10, a triangular hamper 64 is shown comprising a triangularly-shaped bag 66 into which a triangular shell 68 is inserted. It will be appreciated that the rectangular shell 62 and the triangular shell 68 may be provided using any number of types of sheet stock formed to bend at vertical lines to provide the shell structures illustrated. When the shells are not used, of course, they may be folded to provide a flat assembly for shipping purposes.

What is claimed is:

1. A hamper comprising a bag formed to have a closed bottom end, an open top end and sidewall means extending therebetween, generally planar sheet means insertable into said bag to provide an upright support shell for said bag, said shell having an upper edge defining a shell upper opening plane, and said bag having reduction means for drawing said open end into a bag opening smaller than said shell upper opening yet large enough to allow insertion of desired items into said bag and lying generally in said shell upper opening plane.

2. The hamper of claim 1 in which said sidewall means has a length greater than the height of said shell to place said open top end above said shell upper opening plane before said reduction means is operated to reduce said open end.

3. The hamper of claim 1 in which said bottom end is generally circular and said bag is generally cylindrical, said shell comprising a generally rectangular plastic sheet rolled up to have overlapping ends and provide a generally cylindrical shell which is radially expandable from a relatively tightly rolled tubular shape outwardly to the diameter of said bag.

4. The invention of claim 1 in which said bag is a generally cylindrical duffel bag and said reduction means is a drawstring for closing the top end of said bag, said shell being a generally cylindrical shell having a height less than the length of said bag.

5. A laundry bag formed to have a generally circular bottom, a generally cylindrical sidewall, and an open top end, reduction means for reducing said open top end to a bag opening having a size variable from generally equal to the diameter of said bag down to a generally closed opening sufficient to retain the contents of said bag, and upright generally planar sheet means forming a cylindrical shell insertable into said bag to support the bag in an upright standing condition, said shell having an upper edge defining a plane, said shell and said bag being proportioned and designed such that, when said shell is inserted into said bag and said bag opening is reduced to less than the diameter of said shell yet large enough to allow insertion of desired items into said bag, said bag opening will lie generally in the plane of the upper edge of said shell.

6. A laundry hamper comprising a reusable, durable laundry bag made in the form of a right cylindrical duffel bag with a drawstring closure of its top to be used over and over again, an upstanding, right cylindrical shell removably insertable concentrically into the bag to provide a removable support structure for the bag, said shell being formed from a sheet of plastic to have overlapping vertical end edges to be resiliently radially expandable as said drawstring is tightened and loosened, the radially outwardly movement of said shell being limited by the diameter of said bag, and said shell and bag being proportioned and sized such that, when said shell is inserted into the bag and they are placed upright, the drawstring opening can be tightened to provide a horizontal, generally circular top with a generally concentric access opening smaller than the diameter of said bag yet large enough to allow insertion of desired items into said bag and located generally in the plane defined by the upper edge of the Shell.

7. A laundry hamper comprising: a bag having a closed bottom end and sidewall means connected to said closed bottom end; a generally planar sheet insert means inserted into said bag to provide support for said side wall means; said sidewall means having an end extending beyond a top edge of said insert means after insertion of said insert means; opening means at the end of said sidewall means lying generally in a plane defined by the top edge of said insert means to provide an opening of smaller size than said bottom end for insertion of articles into said bag when said insert means is inserted into said bag.

8. The laundry bag of claim 7, wherein the closed bottom end is circular and the opening is circular.

9. The laundry bag of claim 8, wherein there are adjusting means to constrict the size of said opening.

10. The laundry bag of claim 9, wherein: the closed bottom end is defined by a perimeter; and wherein the insert means is a flat shell having a length of approximately the same size as the perimeter of the closed bottom end which is rolled into a generally cylindrical member to permit insertion into the bag with subsequent expansion to a size determined by the area of the closed bottom end of the bag.

11. The laundry bag of claim 7, wherein there are adjusting means to constrict the size of said opening.

12. The laundry bag of claim 7, wherein: the closed bottom end is defined by a perimeter; and wherein the insert means is a flat shell having a length of approximately the same size as the perimeter of the closed bottom end which is rolled into a generally cylindrical member to permit insertion into the bag with subsequent expansion to a size determined by the area of the closed bottom end of the bag.

13. A hamper comprising a bag having a closed bottom end, an open top end and sidewalls extending therebetween, general planer sheet means insertable into said bag to provide an upright support shell for said bag, said shell having an upper opening plane, said bag having means for reducing said shell upper opening along said upper opening plane while maintaining an opening large enough to allow insertion of article into said bag and wherein the sheet is rollable into a tight coil about the bag for insertion into a narrow container for compact storage thereof.

* * * * *

UNITED STATES PATENT AND TRADEMARK OFFICE

CERTIFICATE OF CORRECTION

PATENT NO. : 4,739,880

DATED : April 26, 1988

INVENTOR(S) : Warren D. Sawyer and Mark W. Sawyer

It is certified that error appears in the above-identified patent and that said Letters Patent is hereby corrected as shown below:

At column 2, line 14, please delete "drawstrings" and insert therefor --drawings--.

Signed and Sealed this

Eighteenth Day of October, 1988

*Attest:*

DONALD J. QUIGG

*Attesting Officer*

*Commissioner of Patents and Trademarks*